US005525071A

United States Patent [19]

Obara et al.

[11] Patent Number: 5,525,071

[45] Date of Patent: Jun. 11, 1996

[54] LOW CONNECTION FORCE ELECTRICAL CONNECTOR SYSTEM

[75] Inventors: Shu Obara; Satoshi Mori, both of Tokyo, Japan

[73] Assignee: Hirose Electric Co., Ltd., Tokyo, Japan

[21] Appl. No.: 306,982

[22] Filed: Sep. 16, 1994

[30] Foreign Application Priority Data

Dec. 14, 1993 [JP] Japan ..... 5-072071 U

[51] Int. Cl.[6] ..... H01R 13/62

[52] U.S. Cl. ..... 439/326; 439/636

[58] Field of Search ..... 439/59, 62, 78, 439/326-329, 629-631, 636

[56] References Cited

U.S. PATENT DOCUMENTS

| | | | |
|---|---|---|---|
| 3,920,303 | 11/1975 | Pittman et al. | 439/326 |
| 4,744,764 | 5/1988 | Rubenstein | 439/325 X |
| 4,747,790 | 3/1988 | Masuda et al. | 439/631 |
| 4,941,830 | 7/1990 | Tkazyik et al. | 439/59 |
| 5,104,324 | 4/1992 | Grabbe et al. | 439/630 X |
| 5,197,887 | 3/1993 | Davidge et al. | 439/60 |
| 5,203,725 | 4/1993 | Brunker et al. | 439/636 |
| 5,286,215 | 2/1994 | Dewey et al. | 439/630 X |

FOREIGN PATENT DOCUMENTS

| | | |
|---|---|---|
| 182347 | 4/1992 | China . |
| 0397075 | 11/1990 | European Pat. Off. . |

*Primary Examiner*—Khiem Nguyen
*Attorney, Agent, or Firm*—Kanesaka & Takeuchi

[57] ABSTRACT

A low connection force electrical connector system includes an elongated housing (1); a connection recess (2) extending in a longitudinal direction of said elongated housing and having a regulation face (8) and a guide face (7) in a plane parallel to a bottom face of said elongated housing; at least one upper and one lower channel (3, 4) formed on upper and lower inside walls of said connection recess, respectively; at least one upper and one lower contact element (10, 11) fitted in said upper and lower channel, respectively; and a circuit board (P) having an insertion slope (P1) at a lower front edge thereof.

2 Claims, 2 Drawing Sheets

LOW CONNECTION FORCE ELECTRICAL CONNECTOR SYSTEM

BACKGROUND OF THE INVENTION

1. Field of the Invention

The present invention relates to low connection force electrical connectors.

2. Description of the Related Art

U.S. Pat. No. 5,161,995 discloses a low connection force electrical connector such as shown in FIG. 3. A circuit board P is inserted into a connection recess in a oblique direction (L) and then turned counterclockwise (M) to the horizontal position for lock while making a spring contact with the contact elements 52.

The contact elements 52 are fitted in channels 51A and 51B formed in the housing 51. The contact elements 52 are made by stamping from sheet metal so as to have a rear connection portion 52A and a semi-circular front contact portion 52B with contact terminals 52B1 and 52B2 at opposite ends. The lower contact terminal 52B1 is positioned more forwardly than the upper contact terminal 52B2 by a predetermined length.

The upper and lower front ends 53 and 54 of the connection recess is offset by the same length as the predetermined length. A depression 55 with a shoulder 56 is formed on the bottom of the connection recess.

When the circuit board P is inserted into the connection recess in the oblique direction (L) with no or light contact with the contact terminals 52B1 and 52B2, the lower front edge of the circuit board P is received in the depression 55 during the insertion and turning operation.

Thus, with such a connector it is possible to connect the circuit board to the connector with low connection force while assuring satisfactory contact between the circuit board and the contact elements.

However, it is necessary to make a depression and a shoulder for receiving and turning a circuit board. The depression makes it necessary to divide the metal mold into several pieces and complicates the manufacture, resulting in the high manufacturing costs.

SUMMARY OF THE INVENTION

Accordingly, it is an object of the invention to provide a low connection force electrical connector which is free from the above problem.

According to the invention there is provided a low connection force electrical connector system which includes an elongated housing; a connection recess extending in a longitudinal direction of said elongated housing and having a regulation face and a guide face in a plane parallel to a bottom face of said elongated housing; at least one upper and one lower channel formed on upper and lower inside walls of said connection recess, respectively; at least one upper and one lower contact element fitted in said upper and lower channel, respectively; and a circuit board having an insertion slope at a lower front edge thereof.

In operation, a circuit board is inserted into the connection recess in an oblique direction such that the insertion slope of the circuit board faces downwardly. The front end slides on the guide face to the predetermined position. Since the distance between the upper and lower contact elements is set substantially equal to the thickness of the circuit board, the circuit board is able to advance in the connection recess with no or light contact with the contact elements.

When the circuit board is moved to the predetermined position, it is turned to the horizontal position and brought into spring contact with the contact elements. Excessive turning the circuit board is prevented by the regulation face of the housing to thereby protect the contact elements from plastic deformation.

The above and other objects, features, and advantages of the invention will be more apparent from the following description when taken in conjunction with the accompanying drawings.

DESCRIPTION OF THE PREFERRED EMBODIMENT

Figure 1:
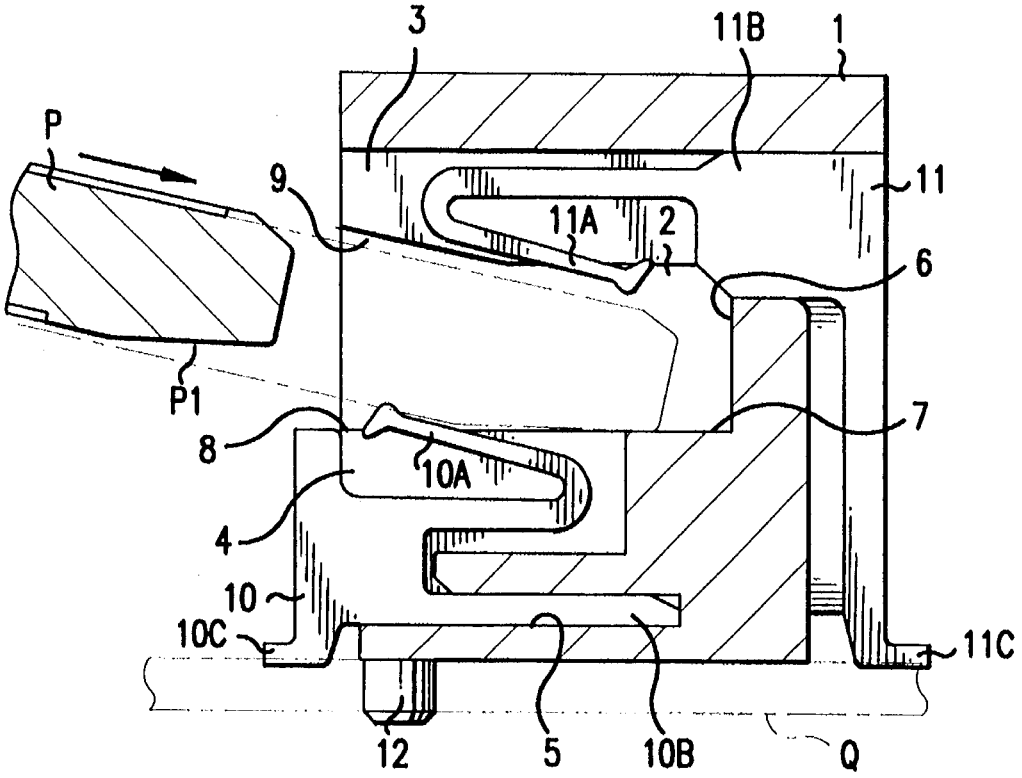
FIG. 1 is a sectional view of an electrical connector according to an embodiment of the invention, into which a circuit board is being inserted.

In FIG. 1, an elongated housing 1 has a substantially square section. A connection recess 2 extends in the longitudinal direction of the elongated housing 1 and has an opening on a front side (the left side in the figure). Channels 3 and 4 are formed on the top and bottom surfaces of the connection recess 2 at regular intervals in the longitudinal direction. The upper channels 3 extend across the front and rear walls of the elongated housing 1 while the lower channels 4 extend through the front wall of the elongated housing 1. Engaging channels 5 extend parallel to and communicate with the lower channels 4 at the front opening.

An abutting face 6 extends upwardly from the bottom guiding face 7 of the connection recess 2 for defining the length of insertion of a circuit board P. A regulation face 8 is formed in the same plane as the guiding face 7 for controlling the turning angle of the circuit board P upon insertion.

A guide slope 9 is formed on a front portion of the upper wall of the connection recess 2 for facilitating the insertion of a circuit board P. The guide slope 9 allows a sloped insertion of the circuit board P without increasing the height of the insertion recess 2 as shown in FIG. 1 thereby making the electrical connector compact.

Lower contact elements 10 inserted in the lower channels 4 are made by stamping from sheet metal so as to have a contact portion 10A extending rearwardly and then forwardly for making contact with the corresponding circuit conductor of a circuit board, an engaging portion 10B fitted into the engaging channel 5, and a connection portion 10C projecting from the bottom of the elongated housing 1.

Similarly, the upper contact elements 11 inserted in the upper channels 3 are made by stamping from sheet metal so as to have a contact portion 11A extending forwardly and then rearwardly for forming a spring contact, an engaging portion 11B for engaging a rear opening of the housing 1, and a connection portion 11C projecting from the bottom of the housing 1.

The upper and lower contact members 10 and 11 are arranged so that the distance between the free ends of the contact portions 10A and 11A in the direction perpendicular to the guide slope 9 is substantially equal to the thickness of a circuit board.

An insertion slope P1 is formed on the lower front edge of a circuit board P. Attaching legs 12 extend downwardly from the bottom of the housing 1 through attaching holes of a circuit board Q for positioning and securing the connector.

In operation, as shown in FIG. 1, the connector is placed at a predetermined position on a circuit board Q such that the attaching legs 12 are inserted into the attaching holes of the circuit board Q. Consequently, the connection portions 10C and 11C of the upper and lower contact elements 10 and 11 are brought into contact with the corresponding circuit portions of the circuit board Q and secured by soldering.

Then, a circuit board P is inserted into the connection recess 2 such that the insertion slope P1 face the lower contact elements 10. The circuit board P is guided by the guide slope 9 while entering the connection recess 2 with no or light contact with the upper and lower contact elements 10 and 11. The insertion slope P1 slides on the guide face 7, and the insertion is complete when the front end abuts against the abutting face 6.

Figure 2:
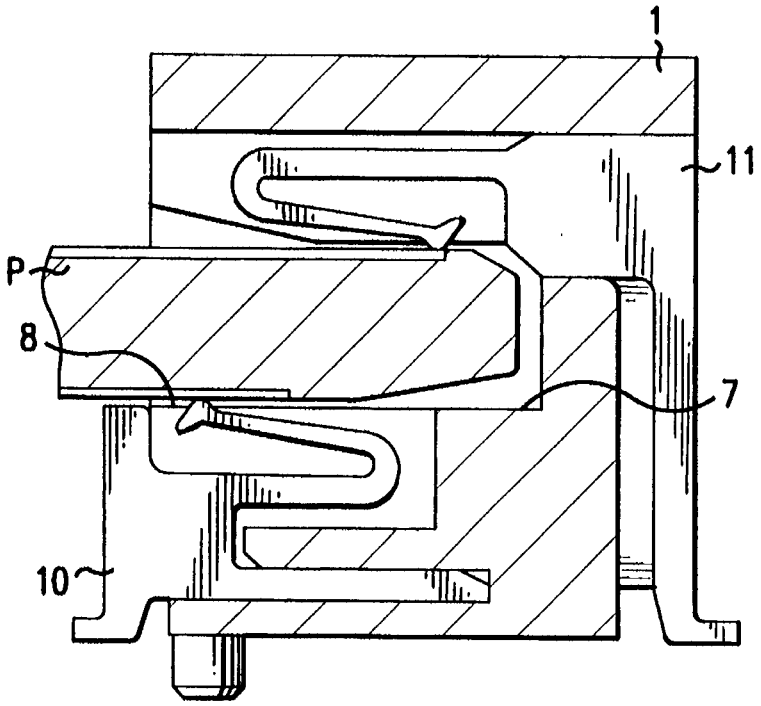
FIG. 2 is a sectional view of the electrical connector in which the circuit board has been inserted.
Figure 3:
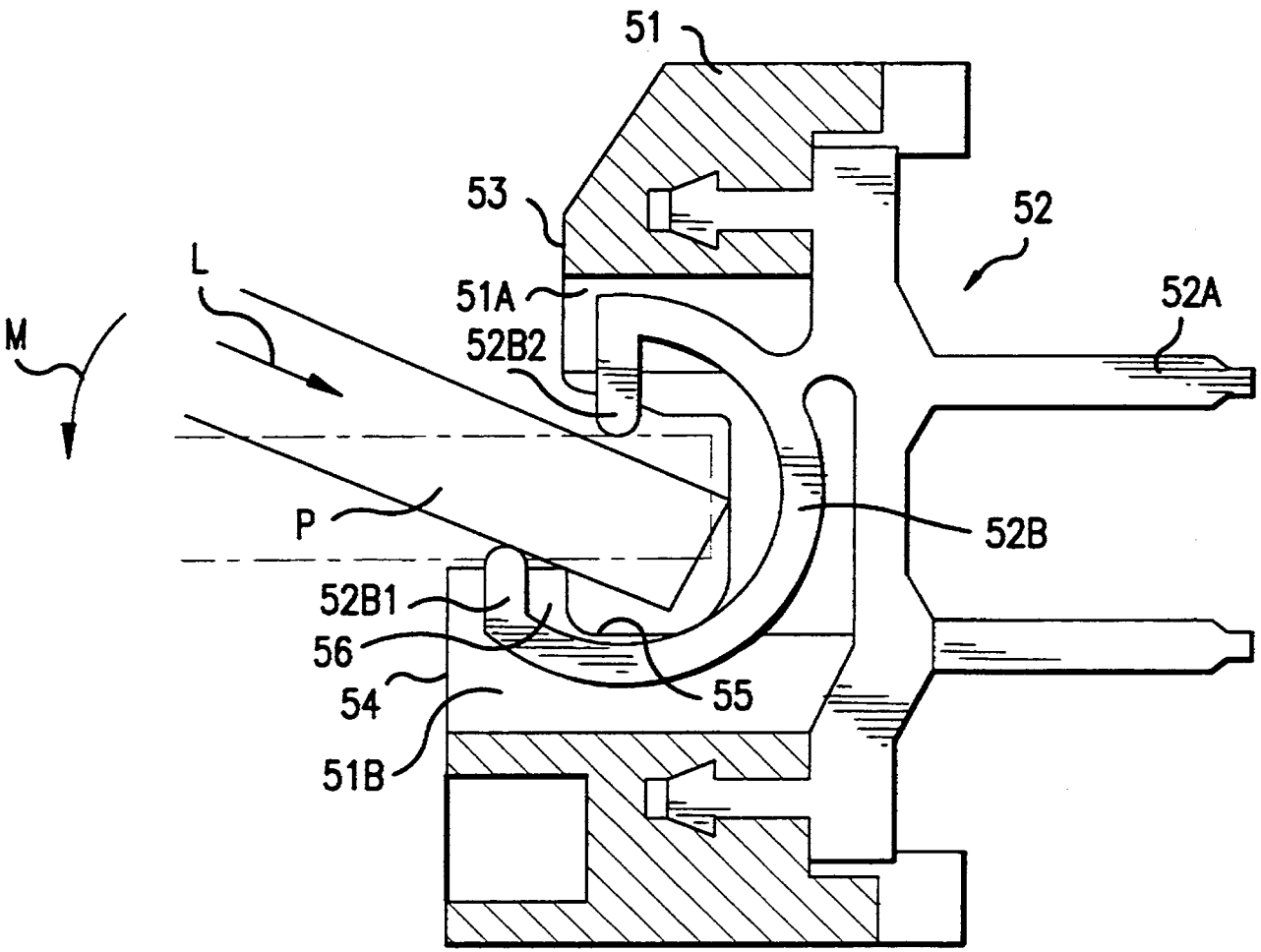
FIG. 3 PRIOR ART
FIG. 3 is a sectional view of a conventional electrical connector.

Then, as shown in FIG. 2, the circuit board P is turned counterclockwise to the horizontal position. In this position, the circuit board P is locked to the connector by a lock (not shown). Thus, the circuit board P is brought into spring contact with the upper and lower contact elements 10 and 11. Any excessive turning of the circuit board P is prevented by the regulation face 8 so that the contact elements 10 and 11 are protected from plastic deformation.

Since there is no depression behind the regulation face for receiving the front end of a circuit board in contrast to the conventional connectors, it is not necessary to divide the metal mold at the depression, thus facilitating the molding process.

The electrical connector according to the invention may be connected to another connector in place of a circuit board.

As has been described above, the electrical connector according to the invention has the regulation face and the guide face in the same plane without any depression between them so that there is no need for dividing the metal mold at the depression, thus reducing the manufacture cost. The guide slope on the upper wall of the connection recess allows the electrical connector to be compact.

We claim:

1. A low connection force electrical connector system, comprising:

an elongated housing;

a connection recess extending in a longitudinal direction of said elongated housing for receiving a mating member and having a regulation face for preventing rotation of said mating member more than a predetermined angle and a guide face for guiding insertion of said mating member into said connection recess;

at least one upper and one lower channel formed in top and bottom walls of said connection recess recess;

at least one upper and one lower contact element fitted in said upper and lower channel, respectively so that said mating member is inserted into said connection recess in an upwardly oblique direction with substantially no contact with said upper and lower contact elements and then turned to a lock position where said mating member is brought into contact with said upper and lower contact elements; and a mating member having an insertion slope at a lower front edge thereof which slidably contacts said guide face when said mating member is inserted into said connection recess in said upwardly oblique direction.

2. The low connection force electrical connector system of claim 1, wherein said top wall is provided with a guide slope for guiding insertion of said circuit board.

* * * * *